US005328080A

United States Patent [19]

Holley, Jr.

[11] Patent Number: 5,328,080

[45] Date of Patent: Jul. 12, 1994

[54] PANEL INTERLOCKING ARRANGEMENT FOR WRAPAROUND CARRIER

[75] Inventor: John M. Holley, Jr., Lawrenceville, Ga.

[73] Assignee: The Mead Corporation, Dayton, Ohio

[21] Appl. No.: 14,899

[22] Filed: Feb. 8, 1993

[51] Int. Cl.[5] ..... B65D 5/02

[52] U.S. Cl. ..... 229/40; 206/140

[58] Field of Search ..... 206/140, 434; 229/40

[56] References Cited

U.S. PATENT DOCUMENTS

| | | | |
|---|---|---|---|
| 3,246,796 | 4/1966 | Englander et al. | 206/140 X |
| 3,356,283 | 12/1967 | Champlin | 229/40 |
| 3,367,557 | 2/1968 | Farquhar | 229/40 |
| 3,410,397 | 11/1968 | Cato | 206/140 |
| 4,077,095 | 3/1978 | Oliff | 24/204 |
| 4,093,116 | 6/1978 | Watkins et al. | 229/40 |
| 4,526,316 | 7/1985 | Sutherland | 229/40 |

FOREIGN PATENT DOCUMENTS

| | | | |
|---|---|---|---|
| 2051604 | 5/1973 | Fed. Rep. of Germany | 229/40 |
| 2433711 | 1/1975 | Fed. Rep. of Germany | 206/434 |
| 191646 | 9/1983 | New Zealand . | |

*Primary Examiner*—Paul T. Sewell
*Assistant Examiner*—Ted Kavanaugh
*Attorney, Agent, or Firm*—Tsugihiko Suzuki

[57] ABSTRACT

A panel-interlocking arrangement for first and second panels overlapping each other, includes locking and retaining tabs struck respectively from the first and second panels, and a biasing tab struck in part from a corner of the retaining tab. The locking tab is foldably joined at its trailing end edge to the first panel and extends along a notional line to its leading end edge. The locking tab has opposite side edges extending between the leading and trailing end edges and a lateral projection protruding from one of the side edges. The retaining tab is foldably joined to the second panel and defines at least a part of a locking aperture in the second panel. The biasing tab is foldably joined to the second panel along a transverse edge of the locking aperture and projects from the transverse edge in the direction parallel to the notional line. The locking tab is folded out of the plane of the first panel into the locking aperture and is disposed in the position where the locking tab is inclined to the second panel. The retaining tab is folded out of the plane of the second panel into the position where the retaining tab is engaged at its free end edge with the lateral projection of the locking tab. The biasing tab is folded out of the plane of the second panel into the position where the biasing tab leans against the locking tab.

13 Claims, 5 Drawing Sheets

PANEL INTERLOCKING ARRANGEMENT FOR WRAPAROUND CARRIER

BACKGROUND OF THE INVENTION

This invention relates to article carriers and more particularly to panel interlocking arrangements for securing together the overlapped ends of wraparound type carrier blanks and is specially adapted to enhance package security in such carrier.

U.S. Pat. No. 4,077,095 issued Mar. 7, 1978 discloses panel interlocking arrangement for securing two overlapped panels. A locking tab having lateral projections is struck from one of the panels, and a retaining tab is struck from the other panel. The locking tab is driven through the locking aperture which is defined by the retaining tab, and thereby the retaining tab is folded out of the plane of the other panel. This causes the locking and retaining tabs to engage each other in angular mutually bracing relation. When the locking tab is driven through the aperture, a securing aperture formed in the base portion of the locking tab receives a securing tab projecting from an edge of the locking aperture. This enhances security of the lock.

New Zealand Patent 191646 issued Sep. 20, 1983 discloses another panel interlocking arrangement. The disclosed arrangement also includes a locking tab having lateral projections and a securing aperture for receiving a securing tab. The arrangement of this patent differs from the above U.S. patent in that it includes two retaining tabs which define a single locking aperture. Insertion of the locking tab into the aperture causes the lateral projections of the locking tab to respectively engage the free end edge of the two retaining tabs which have been folded due to the tab-inserting operation.

In each patent mentioned above, engagement between the securing aperture and the securing tab increases security of the lock on the panels. However, formation of the securing aperture in the locking tab decreases the stress in the locking tab which is induced by folding the locking tab during insertion. Such stress, due to the inherent resistance of the paperboard material from which the locking tab is struck, is important since it tends to urge the locking tab against the retaining tab. This is therefore believed to contribute to stable engagement between the locking and retaining tabs.

What is needed, therefore, is a new arrangement for securing two overlapped panels, wherein stability of engagement between the locking and retaining tabs is increased.

SUMMARY OF THE INVENTION

The present invention provides a panel-interlocking arrangement wherein the inherent resistance of the panel material to bending is effectively utilized to increase stability of interlocking engagement between the panels.

The arrangement for locking first and second panels overlapping each other in face contacting relation, comprises a locking tab struck from the first panel, a retaining tab struck from the second panel, and a biasing tab struck in part from a corner of the retaining tab. The locking tab is foldably joined at its trailing end edge to the first panel and extends along a notional line to a leading end edge. The locking tab has opposite side edges extending between the leading and trailing end edges thereof and a lateral projection protruding from one of the side edges. The retaining tab is foldably joined to the second panel and defines at least a part of a locking aperture in the second panel. The biasing tab is joined to the second panel along a transverse edge of the locking aperture, and projects from the transverse edge in the direction parallel to the notional line. The locking tab is folded out of the plane of the first panel into the locking aperture and is disposed in the position where it is inclined to the second panel. The retaining tab is folded out of the plane of the second panel into the position where it is engaged at its free end edge with the lateral projection of the locking tab. The biasing tab is folded out of the plane of the second panel into the position where it leans against the locking tab.

The locking tab in the folded position is urged against the retaining tab due to the stress in the locking tab induced in response to folding of the locking tab. However, the locking tab is also pressed against the retaining tab by the biasing tab which leans against the locking tab. This results from the fact that the locking tab is folded against the resistance of the biasing tab, as well as against its own resistance, into the position where it is engaged with the retaining tab. These resistances of the panel material cause the locking tab to be actively urged against the retaining tab to hold the locking and retaining tabs in stable interlocking engagement.

According to a preferred embodiment of the invention, the locking tab is joined to the first panel along a fold line which extends continuously and entirely along the trailing end edge of the locking tab. This arrangement increases the folding stress in the locking tab as compared to the folding stress induced in the apertured locking tab of the conventional arrangement such as shown in U.S. Pat. No. 4,077,095 or New Zealand Patent 191646, According to another preferred embodiment, the locking aperture is defined by a pair of retaining tabs. These retaining tabs are moved aside by the locking tab which enters into the locking aperture, and are placed in the positions where they are urged in opposing directions against the locking tab due to the folding stress therein. In this embodiment, it is preferred that the locking tab has a pair of lateral projections protruding respectively from the opposite side edges thereof and that the adjacent corners of the retaining tabs are provided respectively with cutouts for receiving the projections of the locking tab.

While the panel interlocking arrangement of the present invention is well adapted for application to a variety of uses, the high degree of stability of the lock on the panels achieved by the invention renders the invention particularly well suited for high humidity environments and for conditions of rough usage which are characterized by jostling and vibration. Such conditions are typically found in paperboard cartons, particularly for packaging beverage containers such as bottles and cans.

Accordingly, it is an object of the present invention to provide an arrangement for interlocking two panels, wherein the stability of interlocking engagement between the locking and retaining tabs is increased by effectively utilizing the inherent resistance of the material from which the panels are formed.

Other objects and advantages of the present invention will be apparent from the following description, the accompanying drawings and the appended claims.

DETAILED DESCRIPTION OF THE PREFERRED EMBODIMENTS

Figure 1:
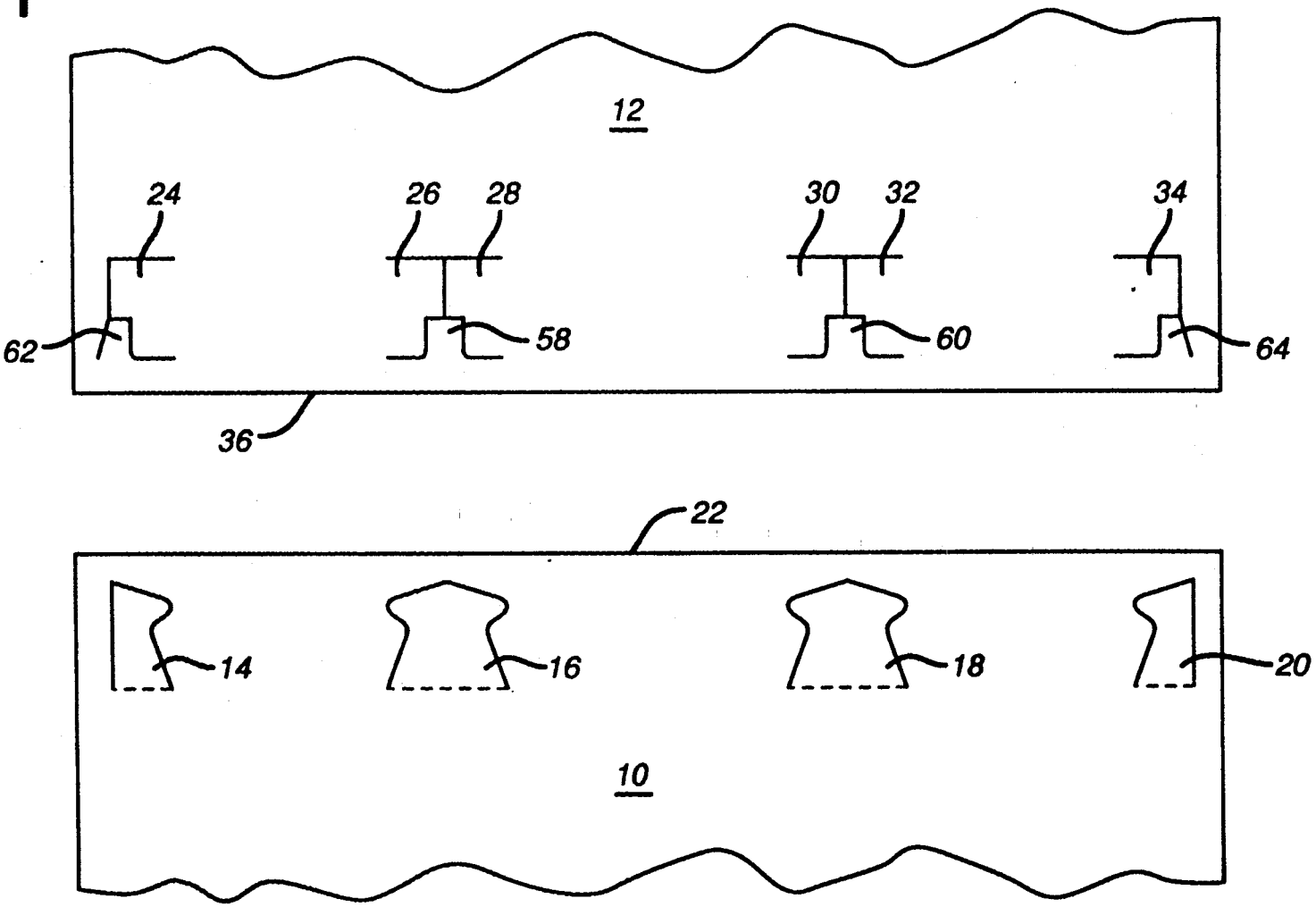
FIG. 1 is a fragmentary plan view of a pair of bottom lap panels to be interlocked together according to the present invention.

Referring now to the drawings, FIG. 1 shows a pair of bottom lap panels 10 and 12 disposed at the opposite ends of a wrap-around type carrier blank formed from paperboard or similar foldable sheet material. These panels 10 and 12 are shown in a separate condition wherein the panels 10 and 12 are disposed adjacent to each other.

As shown in FIG. 1, the bottom lap panel 10 has locking tabs 14–20 struck therefrom and disposed alongside the end edge 22 thereof. The bottom lap panel 12 has retaining tabs 24–34 struck therefrom and disposed alongside the end edge 36 thereof. The locking tabs 14–20 and the retaining tabs 24–34 are foldably joined to their respective panels 10 and 12 from which they are struck. When the retaining tabs 24–34 are folded out of the plane of the panel 12, locking apertures for receiving the locking tabs 14–20 are formed in the panel 12. More particularly, the retaining tabs 24 and 34 respectively define locking apertures for receiving the locking tabs 14 and 20, the retaining tabs 26 and 28 in cooperation define a single locking aperture for receiving the locking tab 16, and the retaining tabs 30 and 32 together define a single locking aperture for receiving the locking tab 18.

The locking tab 14 is of a structure identical to the right half of the tab 16, and the locking tab 20 is of a structure identical to the left half of the tab 16. The retaining tabs 24 and 34 are identical in size and shape respectively to the retaining tabs 28 and 26. Furthermore, the locking tab 18 is identical in size and shape to the locking tab 16, and the retaining tabs 30 and 32 are identical in size and shape respectively to the retaining tabs 26 and 28. Accordingly, only the tabs 16, 26 and 28 will hereinafter be described in reference to FIG. 2, and the description of the other tabs will be omitted.

Figure 2:
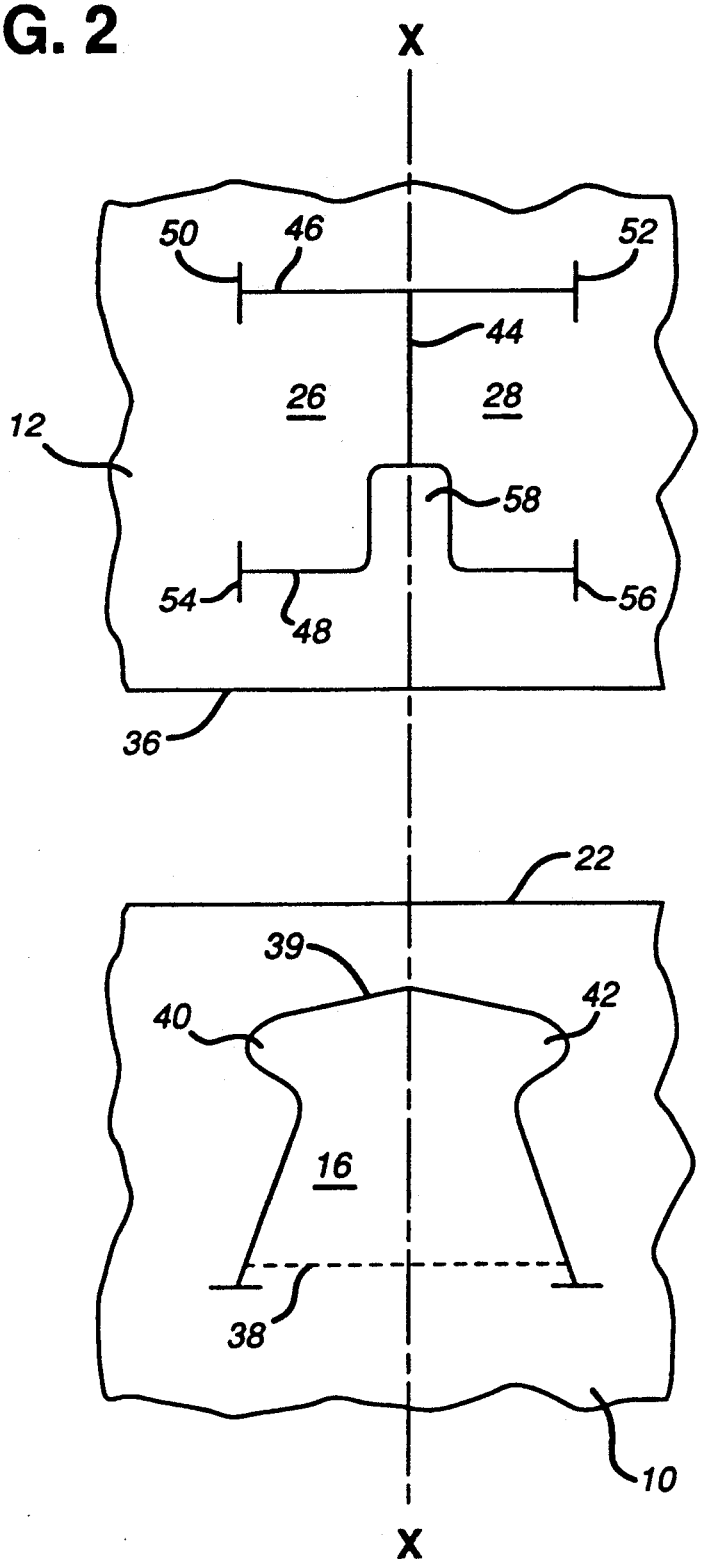
FIG. 2 is an enlarged plan view of a locking and retaining tabs in FIG. 1.

In FIG. 2, the locking tab 16 and the retaining tabs 26 and 28 are shown in enlarged form. As illustrated, the locking tab 16 is joined at its trailing end edge to the panel 10 along a fold line 38 which extends continuously all the way along the trailing end edge of the locking tab 16. The fold line 38 is disposed at a right angle with respect to a notional line X—X along which the locking tab 16 extends to the leading end edge 39. In FIG. 2 wherein the locking tab 16 is disposed in the plane of the panel 10, the notional line X—X is shown as disposed in the plane of the panels 10 and 12; however, the notional line X—X will be inclined to the panels 10 and 12 when the locking tab 16 is folded about the fold line 38 to engage the retaining tabs 26 and 28. The locking tab 16 includes a pair of lateral projections 40 and 42 laterally protruding respectively from the opposite side edges of the locking tab 16 near the leading end edge 39 of the same.

As also shown in FIG. 2, the retaining tabs 26 and 28 are defined by a substantially H-shaped cut. Slits 46 and 48 which correspond to the parallel vertical lines of the letter "H" define the opposite side edges of each of the retaining tabs 26 and 28. A medial slit 44 which corresponds to the horizontal line of the letter "H" separates the retaining tabs 26 and 28 from each other and defines the free end edge of each retaining tab. The other end edges of the retaining tabs 26 and 28 are not particularly defined, and the tabs 26 and 28 are joined at these other end edges to the panel 12.

As further illustrated in FIG. 2, the slit 46 is provided at the opposite ends thereof with short terminal slits 50 and 52 and, likewise, the slit 48 is provided at the opposite ends thereof with terminal slits 54 and 56. The terminal slits 50 and 54 are not continuous but aligned with each other. Therefore, the terminal slits 50 and 54 facilitate folding of the retaining tab 26. In like manner, the terminal slits 52 and 56 facilitate folding of the retaining tab 28.

Figure 3:
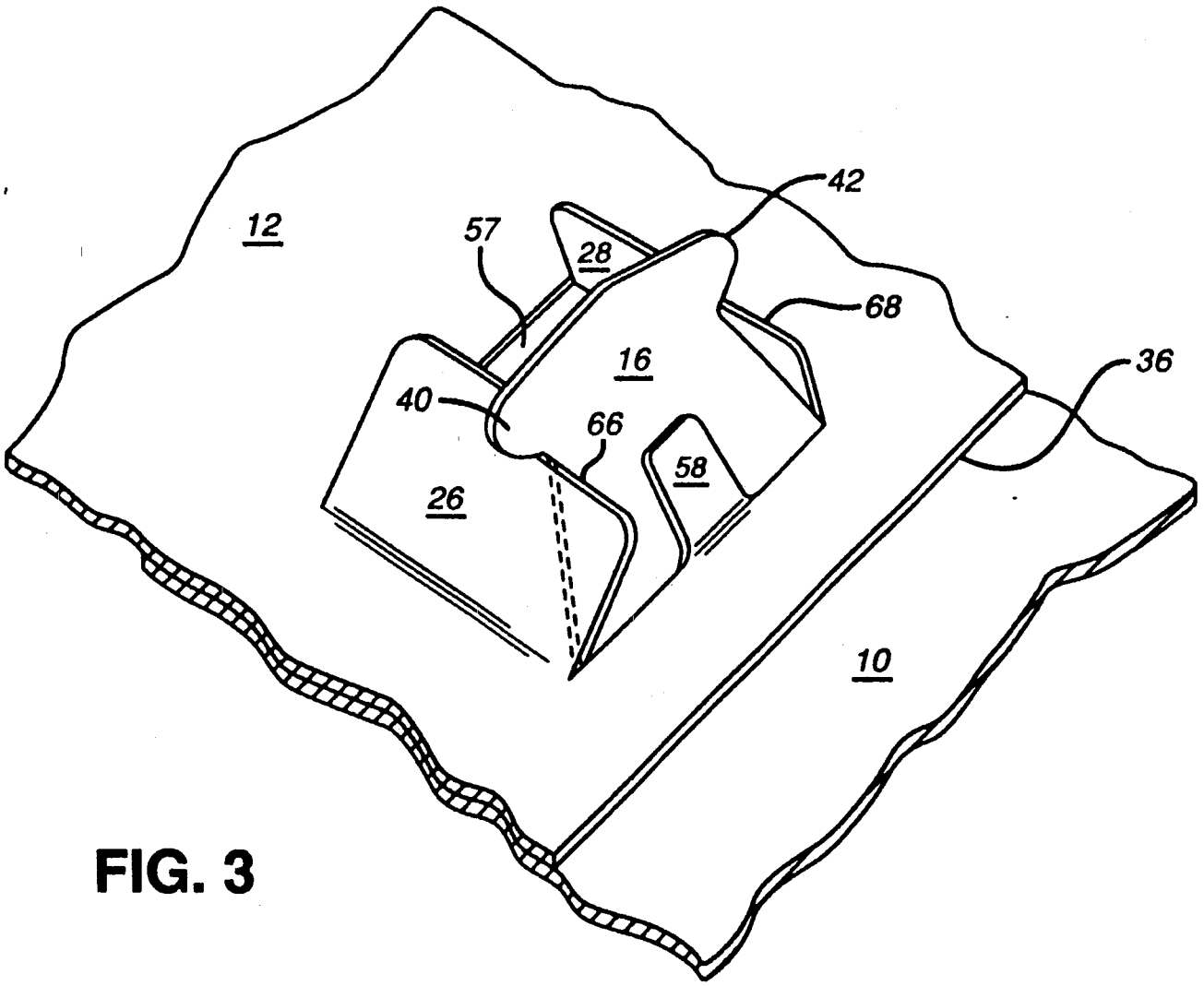
FIG. 3 is a perspective view of the locking and retaining tabs in a mutually braced and engaged condition.

As previously described, folding the retaining tabs 26 and 28 out of the plane of the panel 12 forms a locking aperture 57 (see FIG. 3). The edges of such an aperture defined by the slits 46 and 48 extend at a right angle with respect to the notional line X—X in FIG. 2. A biasing tab 58 is joined to the edge of the aperture defined by the slit 48, and it extends into the aperture defined by the retaining tabs 26 and 28 as shown in FIG. 2. This biasing tab 58 is struck from the adjacent corners of the retaining tabs 26 and 28 which corners are defined between the slits 44 and 48. As a result, cutouts are formed in these corners from which the biasing tab 58 is struck.

The biasing tab 60 in FIG. 1 which is struck from the retaining tabs 30 and 32 is identical in structure to the biasing tab 58. However, the biasing tabs 62 and 64 shown in FIG. 1 are struck partly from their respective retaining tabs 24 and 34 and partly from the panel 12.

The panels 10 and 12 described above are disposed in overlapping relation to each other so that the slit 48 is generally superimposed on the fold line 38, and then they are interlocked together using the above-mentioned tabs to hold the carrier blank tightly around articles such as cans and bottles. Such interlocking operation, generally, is carried out by machine elements, such elements being well known in the art. These machine elements engage the locking tabs 14–20, and in a punch-like operation fold them out of the plane of the panel 10 to drive them through the locking apertures defined by the retaining tabs 24–34. During this driving through operation, the locking tabs 14–20 enter into the respective locking apertures against the resistance of the respective biasing tabs 58–64, and in so doing fold the retaining tabs 24–34 as well as the biasing tabs 58–64 out of the plane of the panel 12. This operation causes the lateral projections of the locking tabs 14–20 to ride into the cutouts respectively of the retaining tabs 24–34 and also causes the biasing tabs 58–64 to lean against the locking tabs 14–20. Each locking tab and the cooperating retaining tab(s) then remain in a mutually braced and engaged condition as illustrated, for example, in FIG. 3.

In FIG. 3, the respective cutouts 66 and 68 of the retaining tabs 26 and 28 are engaged with the lateral projections 40 and 42 of the locking tab 16. In this condition, the locking tab 16 is securely and firmly positioned in its braced and engaged condition as shown in FIG. 3 due to the opposing forces exerted by the retaining tabs 26 and 28 on the locking tab 16. From a different view point, however, the retaining tabs 26 and 28 are securely positioned in their braced and engaged condition due to the force exerted on the retaining tabs 26 and 28 by the locking tab 16. The biasing tab 58 assists the locking tab 16 in exerting the opposing force on the retaining tabs 26 and 28, which results in a stably engaged condition of the tabs 16, 26 and 28.

In a preferred form of the invention and as is apparent from FIG. 3, the retaining tabs 26 and 28 engage the lateral projections 40 and 42 of the locking tab 16 at their corner cutouts 66 and 68. For some applications of the invention, however, it may be satisfactory to arrange the locking tab and the retaining tabs so that the locking tab is engaged by a part of the retaining tab other than the cutout, such as its free end edge.

Figure 4:
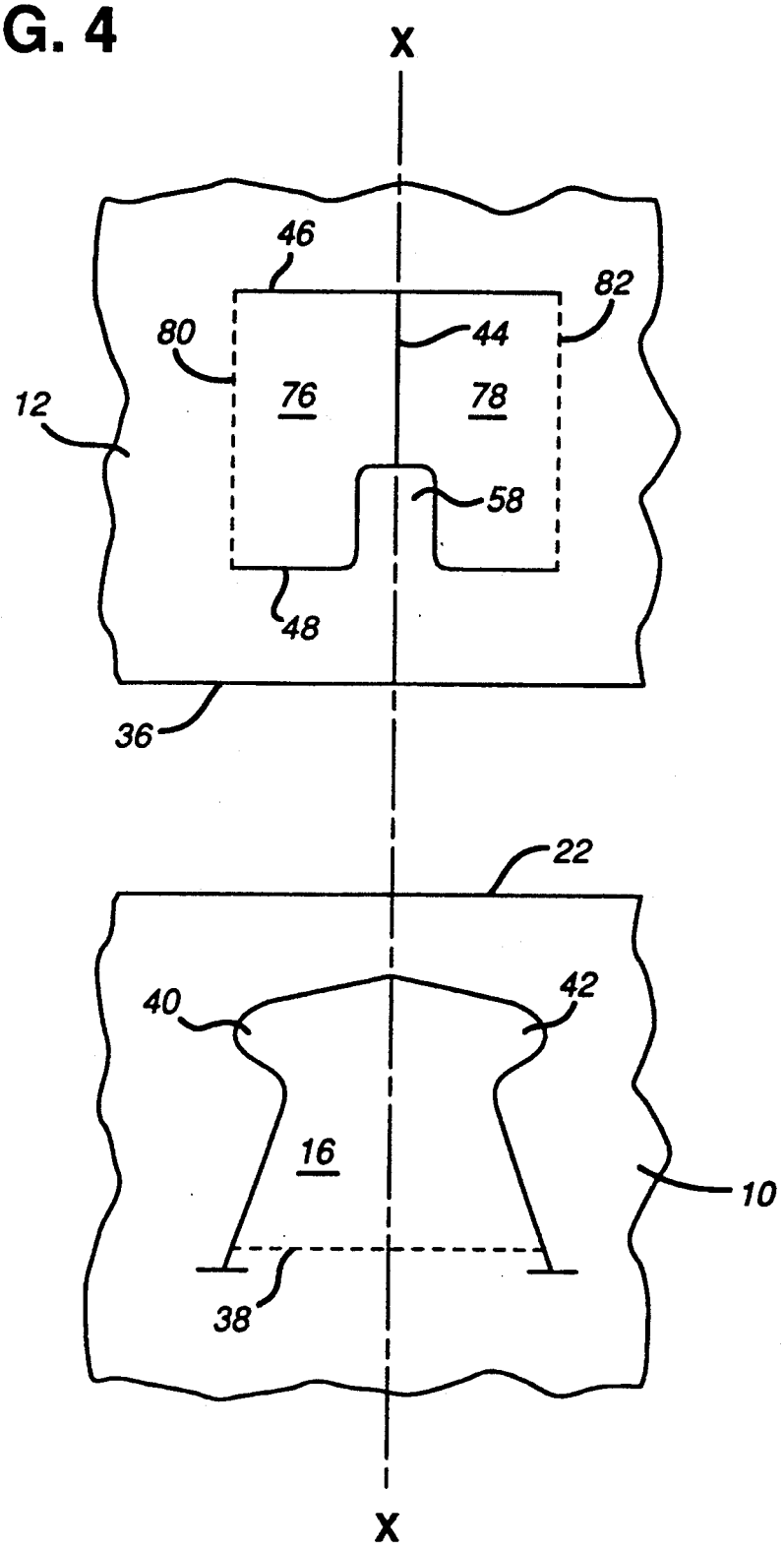
FIG. 4 is a plan view of another form of the present invention, which is similar to FIG. 2.
Figure 5:
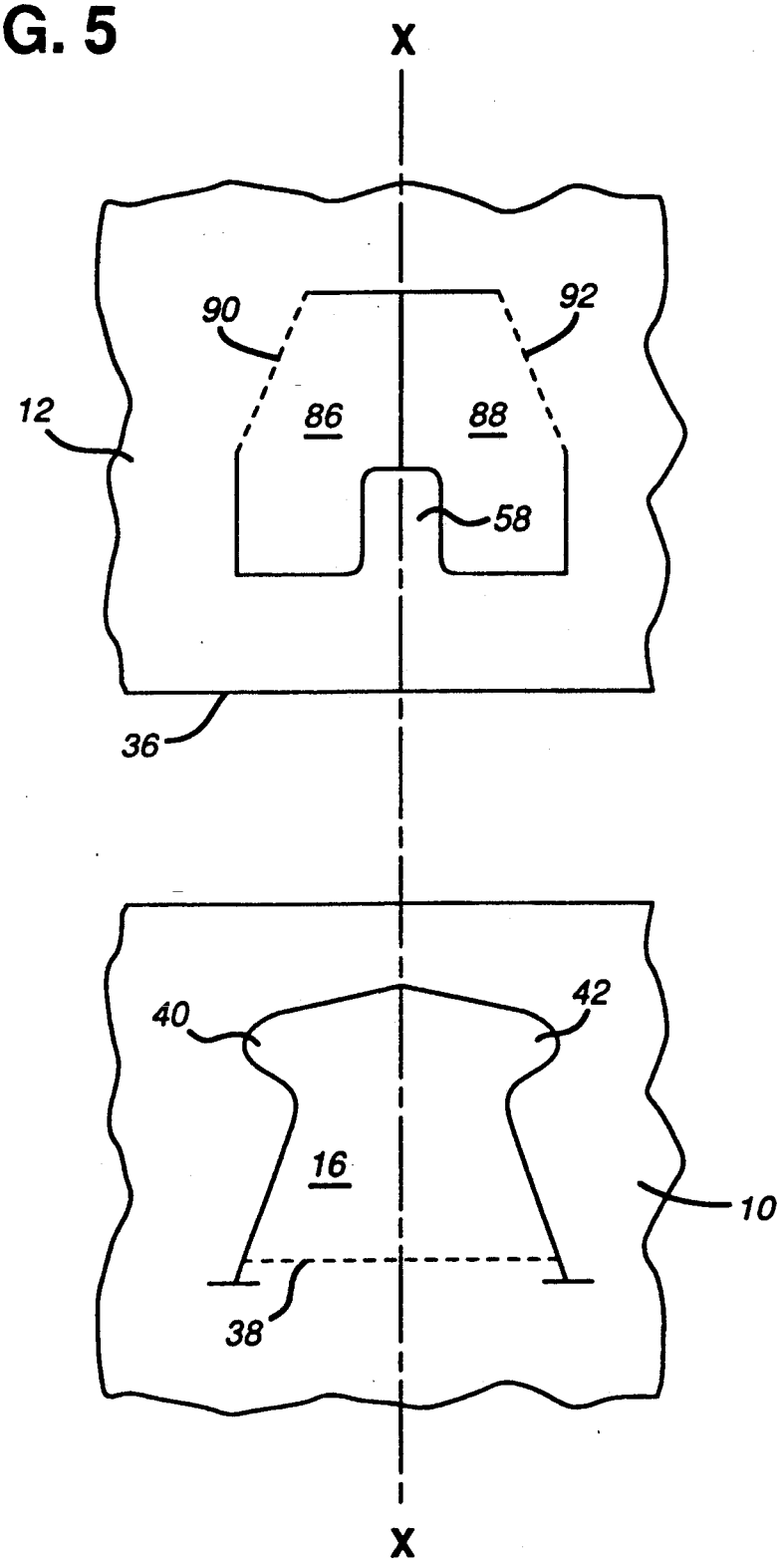
FIG. 5 is a plan view of still another form of the present invention, which is also similar to FIG. 2.

FIGS. 4 and 5 each represent another form of the invention. In FIGS. 4 and 5, portions identical in structure to those in FIGS. 1-3 are designated by like reference numerals and, accordingly, the description thereof will be omitted.

In FIG. 4, the retaining tabs 76 and 78 are foldably joined to the panel 12 along fold lines 80 and 82 which are generally parallel to the notional line X—X. The function of the tabs 76 and 78 is virtually identical to the tabs 26 and 28.

In FIG. 5, the retaining tabs 86 and 88 differ from the those in FIG. 4 in that their fold lines 90 and 92 are inclined to each other and to the notional line X—X. These fold lines 90 and 92 diverge from each other in the direction toward the biasing tab 58. Since the fold lines 90 and 92 of the retaining tabs 86 and 88 are inclined, the angular disposition of the tabs 86 and 88 and the engagement thereof with the locking tab 16 is of a somewhat different orientation than are the orientations of the tabs 26 and 28 as is obvious.

Having described the invention in detail and by reference to the preferred embodiments thereof, it will be apparent that modification and variation are possible without departing from the scope of the invention defined in the appended claims.

What is claimed is:

1. An arrangement for interlocking first and second panels overlapping each other in face contacting relation, said first and second panels defining planes along which said first and second panels respectively extend, said arrangement comprising:

a locking tab struck from said first panel, said locking tab being foldably joined at a trailing end edge thereof to said first panel and extending along a notional line to a leading end edge, said locking tab having opposite side edges extending between said leading and trailing end edges and a lateral projection protruding form one of said side edges;

a retaining tab struck form and foldably joined to said second panel, said retaining tab defining at least a part of a locking aperture in said second panel; and a biasing tab struck in part from a corner of said retaining tab and foldably joined to said second panel along a transverse edge of said locking aperture, said biasing tab projecting from said transverse edge in a direction parallel to said notional line, said locking tab being folded out of the plane of said first panel into said locking aperture and being disposed in a position where said locking tab is inclined to said second panel, said retaining tab being folded out of the plane of said second panel into a position where said retaining tab is engaged at a free end edge thereof with said lateral projection of said locking tab, said biasing tab being folded out of the plane of said second panel into a position where said biasing tab leans against said locking tab, thereby biasing said locking tab against said retaining tab to hold said locking and retaining tabs in a mutually bracing and engaged condition.

2. The arrangement according to claim 1, wherein said locking tab is joined to said first panel along a fold line which extends continuously and entirely along said trailing end edge of said locking tab.

3. The arrangement according to claim 2, wherein said fold line extends generally perpendicularly to said notional line.

4. The arrangement according to claim 1, wherein said retaining tab is joined to said second panel along a fold line.

5. The arrangement according to claim 4, wherein said fold line extends generally parallel to said notional line when said locking tab is disposed in the plane of said first panel.

6. The arrangement according to claim 4, wherein said fold line extends in a direction inclined to said notional line when said locking tab is disposed in the plane of said first panel.

7. The arrangement according to claim 1, wherein said corner of said retaining tab is provided with a cutout as a result of a part of said biasing tab struck therefrom, and said projection of said locking tab is received in said cutout.

8. The arrangement according to claim 1, wherein said locking aperture is defined by a pair of retaining tabs, and said biasing tab is struck from adjacent corners of said retaining tabs.

9. The arrangement according to claim 8, wherein said locking tab has a pair of lateral projections projecting respectively from said opposite side edges, said adjacent corners of said retaining tabs are provided respectively with cutouts as a result of said biasing tab struck therefrom, and said projections of said locking tab are received respectively in said cutouts.

10. The arrangement according to claim 8, wherein each of said retaining tabs is joined to said second panel along a fold line, and said fold lines of said retaining tabs diverge from each other in the direction of said biasing tab.

11. The arrangement according to claim 8, wherein each of said retaining tabs is joined to said second panel along a fold line which extends generally parallel to said notional line when said locking tab is disposed in the plane of said first panel.

12. The arrangement according to claim 8, wherein edges of each of said retaining tabs which define respective one of said adjacent corners are disposed in substantially normal relation to each other.

13. The arrangement according to claim 1, wherein said biasing tab is superposed on said locking tab and extends along the surface of the locking tab.

* * * * *

UNITED STATES PATENT AND TRADEMARK OFFICE

CERTIFICATE OF CORRECTION

PATENT NO. : 5,328,080

DATED : July 12, 1994

INVENTOR(S) : John M. Holley, Jr.

It is certified that error appears in the above-identified patent and that said Letters Patent is hereby corrected as shown below:

Column 5, line 57, "form" should read --from--.

Signed and Sealed this

Fifth Day of March, 1996

*Attest:*

Bruce Lehman

BRUCE LEHMAN

*Attesting Officer*

*Commissioner of Patents and Trademarks*